US007905196B2

(12) United States Patent
Yasui

(10) Patent No.: US 7,905,196 B2
(45) Date of Patent: Mar. 15, 2011

(54) AEROSOL GENERATING APPARATUS, METHOD FOR GENERATING AEROSOL AND FILM FORMING APPARATUS

(75) Inventor: Motohiro Yasui, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 690 days.

(21) Appl. No.: 11/688,687

(22) Filed: Mar. 20, 2007

(65) Prior Publication Data

US 2007/0235048 A1 Oct. 11, 2007

(30) Foreign Application Priority Data

Mar. 28, 2006 (JP) ..... 2006-088625

(51) Int. Cl.
*B05D 3/04* (2006.01)

(52) U.S. Cl. ..... 118/303; 137/1; 137/8; 137/44

(58) Field of Classification Search ..... 137/1, 8, 137/44; 427/213; 118/303
See application file for complete search history.

(56) References Cited

U.S. PATENT DOCUMENTS 3,994,824 A * 11/1976 White et al. ..... 422/145
4,594,270 A * 6/1986 Brooks ..... 427/213
5,976,365 A * 11/1999 Petit ..... 210/151
6,684,917 B2 * 2/2004 Zhu et al. ..... 141/18
2003/0157246 A1 * 8/2003 Jensen ..... 427/212

FOREIGN PATENT DOCUMENTS

JP 2001152360 A 6/2001
JP 2001170551 A 6/2001
JP 2001348658 A 12/2001
JP 2004113931 A 4/2004

* cited by examiner

*Primary Examiner* — Parviz Hassanzadeh
*Assistant Examiner* — Albert Hilton
(74) *Attorney, Agent, or Firm* — Baker Botts L.L.P.

(57) ABSTRACT

There is provided an aerosol generating apparatus which is capable of generating aerosol stably. The aerosol generating apparatus includes a container which mixes a particulate material and a carrier gas to generate a fluidized bed of the particulate material; an aerosol delivery tube which sucks a part of the fluidized bed to deliver the part as an aerosol containing the particulate material and the carrier gas; an optical sensor which measures a position of the fluidized bed; and an adjusting unit which adjusts the position of the aerosol delivery tube based on an information about the position of the fluidized bed measured by the optical sensor. By moving an end of the aerosol delivery tube horizontally along and relative to the top surface of the fluidized bed, it is possible to avoid harmful effect that particle size distribution in the fluidized bed becomes locally non-uniform.

16 Claims, 3 Drawing Sheets

AEROSOL GENERATING APPARATUS, METHOD FOR GENERATING AEROSOL AND FILM FORMING APPARATUS

CROSS REFERENCE TO RELATED APPLICATION

The present application claims priority from Japanese Patent Application No. 2006-088625 filed on Mar. 28, 2006, the disclosure of which is incorporated herein by reference in its entirety.

BACKGROUND OF THE INVENTION

1. Field of the Invention

The present invention relates to an aerosol generating apparatus, a method for generating aerosol and a film forming apparatus.

2. Description of the Related Art

As example of a method for producing a piezoelectric actuator used, for example, for an ink-jet head of an ink-jet printer, there is aerosol deposition method (AD method). In the AD method, aerosol formed by dispersing fine particles of a piezoelectric material such as lead zirconate titanate (PZT) or the like in a gas (aerosol) is ejected (jetted) toward a surface of a substrate to make the fine particles collide on and to be deposited onto the substrate, thereby forming a piezoelectric film.

In the AD method, as an example of a mechanism for generating the aerosol, there is known a mechanism for generating aerosol provided with a vibrating unit (see Japanese Patent Application Laid-open No. 2001-152360). This aerosol generating mechanism includes a gas cylinder, an aerosol generating chamber, and a vibrating unit, and introduces a carrier gas from the gas cylinder to the aerosol generating chamber so as to raise particulate material (material particles) up with gas pressure of the carrier gas and to vibrate a container of the aerosol generating chamber to which the carrier gas and the particulate material are introduced, thereby mixing the particulate material and the carrier gas to generate aerosol. The generated aerosol is sucked to a delivery tube by a pressure difference between the aerosol generating chamber and a film forming chamber so that the aerosol is introduced to a nozzle in the film forming chamber. Then, the aerosol is ejected from this nozzle toward a substrate.

Other than this mechanism, there has been also proposed a mechanism adopting suction system in which particulate material is sucked together with a carrier gas by suction force generated when the carrier gas is sucked into a delivery tube.

In order to perform film formation stably, it is important to maintain a concentration of aerosol generated in the aerosol generating chamber (aerosol concentration) to be constant. In the above-described mechanism provided with the vibration unit, however, there is a problem that the particulate material is gradually aggregated and solidified due to the applied vibration, and consequently the particulate material loses fluidity, thereby lowering the aerosol concentration. On the other hand, with the apparatus adopting the suction system, there is a problem that the particulate material easily clogs at an inlet of the delivery tube.

SUMMARY OF THE INVENTION

The present invention is made in view of the above-described situations, and an object of the present invention is to provide an aerosol generating apparatus, a method for generating aerosol and a film forming apparatus each of which is capable of generating an aerosol in a stable manner.

According to a first aspect of the present invention, there is provided an aerosol generating apparatus which generates aerosol in which a particulate material is dispersed in a carrier gas, including: a container having a partition which partitions the container into a powder-accommodating chamber accommodatable the particulate material and a blower chamber disposed below the powder-accommodating chamber, a hole for passing the carrier gas being formed on the partition, and a fluidized bed of the particulate material being formed in the powder-accommodating chamber by the carrier gas supplied from the blower chamber; a gas supply section which supplies the carrier gas to the blower chamber; an aerosol delivery tube which has a suction port, and an end of which is inserted to the powder-accommodating chamber; and a vertical position adjusting mechanism which adjusts a vertical position of the suction port of the aerosol delivery tube relative to a position the fluidized bed. Here, the term "relative to" includes both a concept of moving the aerosol delivery tube in a state that the powder-accommodating chamber is fixed, and a concept of moving the powder-accommodating chamber in a state that the aerosol delivery tube is fixed.

According to the first aspect of the present invention, the formation of the fluidized bed makes it possible to prevent the particulate material from aggregating and solidifying and to realize uniform particle size distribution (particle diameter distribution) in a direction of height of the fluidized bed (bed-height direction, vertical direction). In addition, the vertical position adjusting mechanism is provided to adjust the vertical direction of the suction port of the aerosol delivery tube with respect to (a top layer of) the fluidized bed, thereby suppressing the fluctuation in aerosol concentration due to the change in height (suction height) at which the aerosol is sucked from the top layer of the fluidized bed to the aerosol delivery tube. With these, the aerosol can be supplied in a stable manner.

The aerosol generating apparatus of the present invention may include a horizontal driving mechanism which moves the suction port horizontally relative to the powder-accommodating chamber. Here, the term "move horizontally" or "horizontal movement" may include any movement provided that the movement is in a horizontal direction. For example, the movement may be a linear reciprocating movement or a rotational movement.

In this case, since the aerosol generating apparatus is provided with horizontal driving mechanism, the suction port of the aerosol delivery tube can be moved horizontally along the top surface of the fluidized bed. With this, it is possible to avoid harmful effect which would be otherwise caused that the particle distribution becomes non-uniform when the suction is continued only at a specific position, thereby stabilizing the concentration of the aerosol supplied.

The aerosol generating apparatus of the present invention may further include a measuring unit which measures the position of the fluidized bed; wherein the vertical position adjusting mechanism may adjust the vertical position of the suction port based on a data about the position of the fluidized bed measured by the measuring unit.

In this case, the aerosol generating apparatus is provided with the measuring unit which measures the position of the top layer of the fluidized bed; and the vertical position adjusting mechanism adjusts the vertical position of the suction port, of the aerosol delivery tube, based on the data about the position of the top layer measured by the measuring unit. Accordingly, even when the particulate material is consumed by an operation performed for a long period of time and consequently the position of the top layer of the fluidized bed is lowered, the vertical position of the suction port is automatically adjusted such that the suction of the particulate material contained in the aerosol can be performed appropriately.

In the aerosol generating apparatus of the present invention, the measuring unit may include a non-contact type sensor; and the non-contact type sensor may be arranged outside the container. Further, the non-contact type sensor may be an optical sensor.

In this case, since the measuring unit includes the non-contact type sensor and this sensor is arranged outside the powder-accommodating chamber, it is possible to operate the measuring unit outside the powder-accommodating chamber, which in turn makes it easy to measure the position of the top layer of the fluidized bed. In addition, no particles are adhered to the measuring unit unlike in a case in which a measuring unit is arranged inside the powder-accommodating chamber. Accordingly, it is possible to prevent the measuring accuracy from lowering and to facilitate the maintenance work. As the non-contact type sensor, it is also allowable, for example, to use a supersonic sensor which measures the position of the top layer of the fluidized bed by employing reflection of supersonic wave. The optical sensor, however, has such advantages that the optical sensor has high noise resistance and that the optical sensor can be used stably even at atmospheric pressure. Therefore, the use of optical sensor is advantageous.

In the aerosol generating apparatus of the present invention, the horizontal driving mechanism may be a rotation device which rotates the container while holding the container thereon. In this case, even when the horizontal position of the suction port is fixed, the container can be rotated to thereby moving the suction port relative to the top layer of the fluidized bed along a circumference direction of the container. Accordingly, there is no fear that the suction is continued only at a specific position.

In the aerosol generating apparatus of the present invention, the partition may include a plate having a projection which projects upwardly; and the hole may have an opening in a lower surface of the plate, and may be formed to include an air hole which is formed inside the projection to extend upwardly and a blow hole which communicates with the air hole and which is formed penetrating through a side surface of the projection in an obliquely downward direction. In this case, since the blow hole is formed to extend in the obliquely downward direction, the carrier gas supplied to the blower chamber can be blown downwardly in the powder-accommodating chamber. This in turn makes possible to prevent the gas from remaining on the upper surface of the plate.

According to a second aspect of the present invention, there is provided an aerosol generating apparatus which generates aerosol in which a particulate material is dispersed in a carrier gas, the apparatus including: a container having a partition which partitions the container into a powder-accommodating chamber accommodatable the particulate material and a blower chamber disposed below the powder-accommodating chamber, a hole for passing the carrier gas being formed on the partition, and a fluidized bed of the particulate material being formed in the powder-accommodating chamber by the carrier gas supplied from the blower chamber; a gas supply section which supplies the carrier gas to the blower chamber and fluidizes the particulate material accommodated in the powder-accommodating chamber to generate the fluidized bed; and an adjusting mechanism which adjusts a supply amount of the carrier gas to the blower chamber to make a fluidization velocity of the fluidized bed to be not more than twice a minimum fluidization velocity with respect to a central particle size of the particulate material.

According to the second aspect of the present invention, the aerosol generating apparatus has the adjusting mechanism which adjusts the supply amount of the carrier gas to the blower chamber such that the fluidization velocity of the fluidized bed is not more than twice the minimum fluidization velocity with respect to the central particle size of the particulate material (central particle size of the particles of particulate material). Accordingly, it is possible to suppress the generation of bubble of the carrier gas between the particles of the particulate material, and thus to suppress the disturbance in the top surface of the fluidized bed due to the gas bubbles.

According to a third aspect of the present invention, there is provided a method for generating aerosol in which a particulate material is dispersed in a carrier gas, the method including: a charging step for charging the particulate material to a container having a partition which partitions the container into a powder-accommodating chamber accommodatable the particulate material and a blower chamber disposed below the powder-accommodating chamber, a hole for passing the carrier gas being formed on the partition, and the particulate material being charged to the powder-accommodating chamber; a forming step for forming a fluidized bed of the particulate material in the powder-accommodating chamber by supplying the carrier gas from the blower chamber and by ejecting the carrier gas from the hole; a delivering step for delivering the fluidized particulate material to an aerosol delivery tube while arranging a suction port of the aerosol delivery tube to a position near to the fluidized bed; and an adjusting step for adjusting a supply amount of the carrier gas to the blower chamber to make a fluidization velocity of the fluidized bed to be not more than twice a minimum fluidization velocity with respect to a central particle size of the particulate material. Here, the term "position near to" may a position at which the suction port makes no contact with the top layer of the fluidized bed and the suction port is capable of sucking the carrier gas and the particulate material forming the fluidized bed.

According to the third aspect of the present invention, the formation of the fluidized bed makes it possible to prevent the particulate material from aggregating and solidifying and to realize uniform particle size distribution in the bed-height direction. In addition, the suction port of the aerosol delivery tube is arranged at a position with respect to the top layer of the fluidized by while maintaining a predetermined distance between the suction port and the top layer, thereby suppressing the fluctuation in aerosol concentration due to the change in suction height at which the aerosol is sucked from the top layer of the fluidized bed to the aerosol delivery tube. With these, the aerosol can be supplied in a stable manner. Further, by adjusting the supply amount of the carrier gas such that the fluidization velocity of the fluidized bed is made to be not more than twice of the minimum fluidization velocity with respect to the central particle size of the particles of the particulate material, it is possible to suppress the disturbance in the fluidized-bed surface due to gas bubbles which are generated between the particles and which rise upwardly.

In the method for generating the aerosol of the present invention, the particulate material may be lead zirconate titanate (PZT). In this case, a piezoelectric layer using the PZT can be produced stably.

According to a fourth aspect of the present invention, there is provided a film forming apparatus which forms a film of a particulate material on a substrate by blowing onto the substrate an aerosol in which the particulate material is dispersed in a carrier gas, the apparatus including: an aerosol generator generating the aerosol and including a container having a partition which partitions the container into a powder-accommodating chamber accommodatable the particulate material and a blower chamber disposed below the powder-accommodating chamber, a hole for passing the carrier gas being formed on the partition, and a fluidized bed of the particulate material being formed in the powder-accommodating chamber by the carrier gas supplied from the blower chamber; a gas supply section which supplies the carrier gas to the gas-introducing chamber; an aerosol delivery tube which has a suction port, an end of which is inserted to the powder-accommodating chamber; and a vertical position adjusting mechanism which adjusts a vertical position of the suction port of the aerosol delivery tube relative to a position of the fluidized bed; and an ejection nozzle which is connected to the other end of the aerosol delivery tube and which ejects the aerosol toward the substrate.

According to the fourth aspect of the present invention, the formation of the fluidized bed makes it possible to prevent the particulate material from aggregating and solidifying and to realize uniform particle size distribution in the bed-height direction (vertical direction). In addition, the vertical position adjusting mechanism is provided to adjust the vertical position of the suction port, of the aerosol delivery tube, with respect to the top layer of the fluidized bed, thereby suppressing the fluctuation in aerosol concentration due to the change in suction height at which the aerosol is sucked from the top layer of the fluidized bed to the aerosol delivery tube. With these, the aerosol can be supplied in a stable manner and thus to improve the quality of the formed film.

DESCRIPTION OF THE PREFERRED EMBODIMENTS

In the following, the present invention will be explained in detail by an embodiment thereof with reference to FIGS. 1 and 2.

Figure 1:
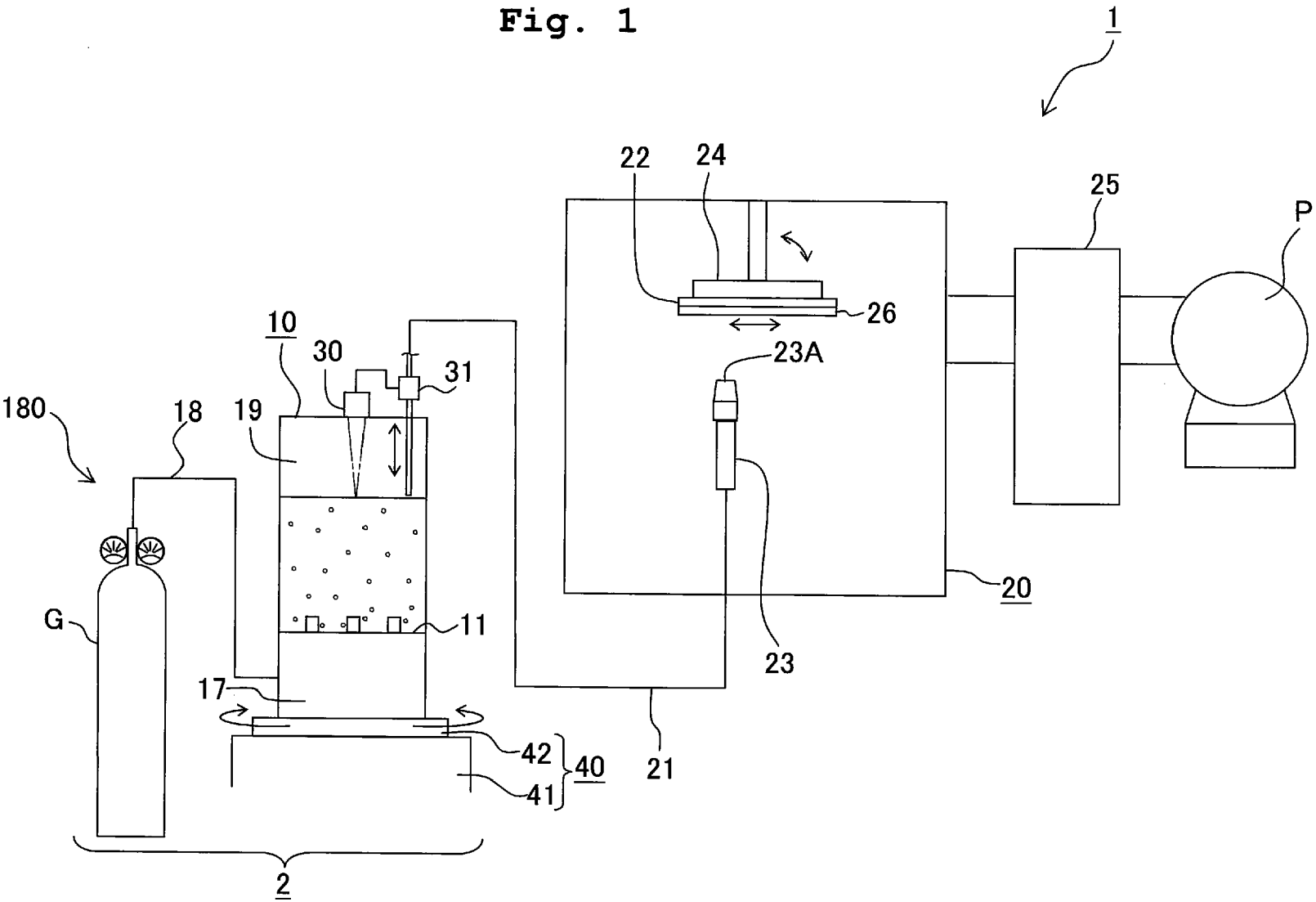
FIG. 1 is a schematic view of a film forming apparatus according to an embodiment of the present invention.

FIG. 1 schematically shows a film forming apparatus 1 which embodies the present invention. The film forming apparatus 1 is provided with an aerosol generating apparatus (aerosol generator, aerosol generating apparatus) 2 for forming an aerosol by dispersing a particulate material (material particles) in a carrier gas; and a film forming chamber 20 for ejecting the generated aerosol from an ejection nozzle 23 to adhere particulate material contained in the aerosol to a substrate (process-objective member) 26.

First, the aerosol generating apparatus 2 will be explained. The aerosol generating apparatus 2 is provided with an aerosol generator 10 (container) which is formed in a circular cylinder-shaped shape. The inside of the aerosol generator 10 is partitioned into upper and lower chambers with a distribution plate 11 (partition). In other words, the aerosol generator 10 is partitioned into two chambers with the distribution plate 11.

Figure 2:
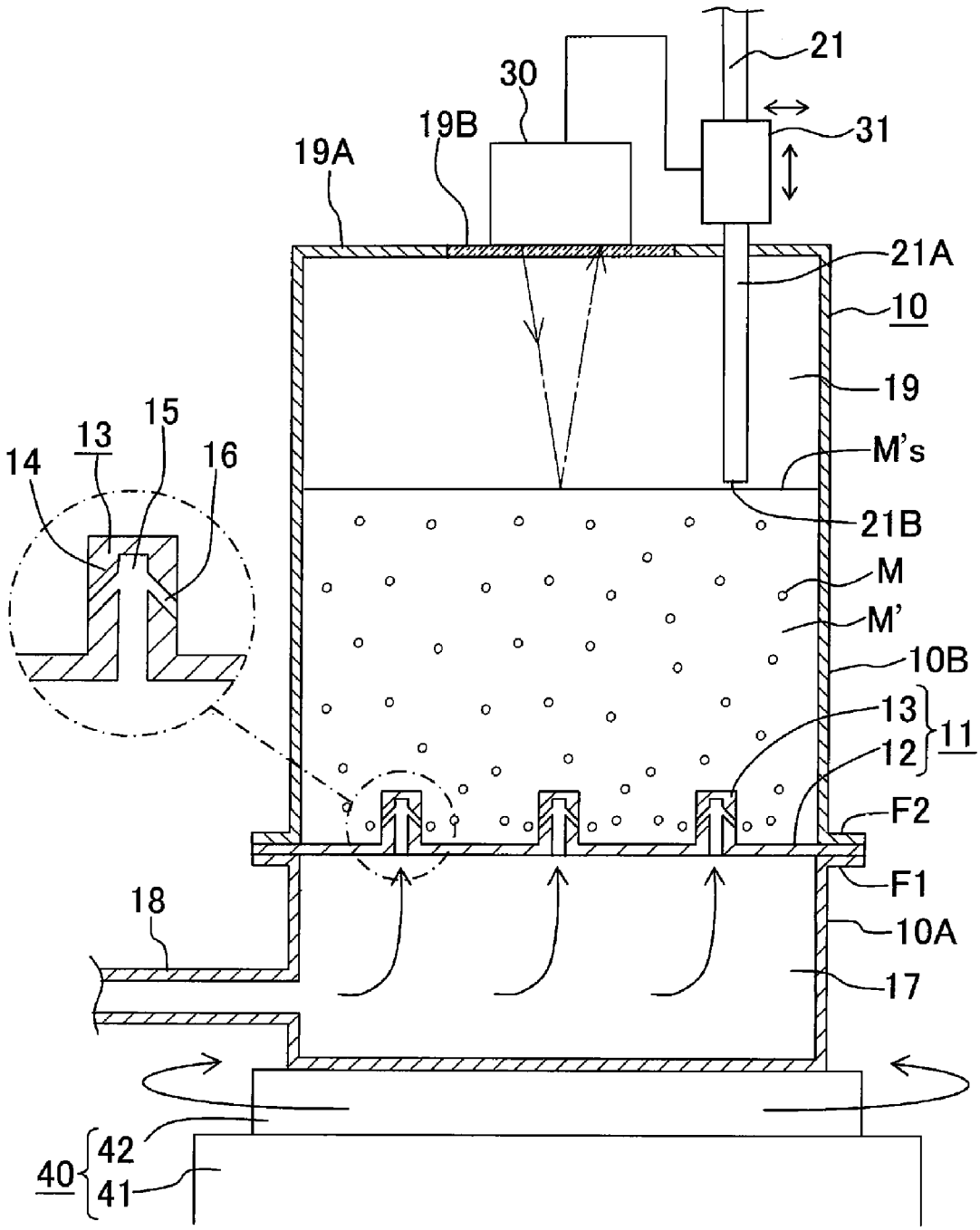
FIG. 2 is a schematic cross-sectional view of an aerosol generator according to the embodiment.

As shown in FIG. 2, the aerosol generator 10 is provided with a lower container 10A which is formed in a circular-cylindrical shape and which is open at its upper end, and a upper container 10B which has a same diameter as that of the lower container 10A and which is open at its lower end. Flange portions F1, F2 are provided on the openings of the lower and upper containers 10A, 10B, respectively. The entire flange portions F1, F2 protrude toward outer side in a radial direction of the respective containers. The distribution plate 11 is a multi-nozzle plate which includes a disc-shaped plate portion 12 and a large number of gas dispersing nozzles 13 formed in the plate portion 12. The distribution plate 11 has an outer diameter which is approximately same as those of the flange portions F1, F2 of the lower and upper containers 10A, 10B. The plate portion 12 is overlaid on the flange portion F1 of the lower container 10A and further the upper container 10B is overlaid on the plate portion 12. The aerosol generator 10, partitioned in two chambers of the upper and lower chambers, is constructed by supporting the plate portion 12 with the lower and upper containers 10A, 10B while sandwiching the outer circumferential edge of the plate portion 12 between the flange portions F1, F2 of the lower and upper containers 10A, 10B.

The gas dispersing nozzles 13 are formed in a circular-cylindrical shape and are provided with stand pipes 14, respectively. Each of the stand pipes 14 is formed in an upstanding manner on the upper surface of the plate portion 12, and is closed at its opening in its upper side. An air hole 15 which opens downwardly is formed inside each of the stand pipes 14. Further, a plurality of blow holes 16 are formed in each of the stand pipes 14 to extend obliquely outwardly in the radial direction and communicate the air hole 15 and space outside the air hole 15. The blow holes 16 are provided at a constant pitch in the circumferential direction. In such a manner, by forming the blow holes 16 such that the air-blowing side thereof is directed downwardly, the carrier gas can be ejected in an obliquely downward direction, thereby preventing the carrier gas from remaining on the upper surface of the plate portion 12. The air hole 15 and the blow holes 16 construct the hole of the present invention.

Among the chambers partitioned by the distribution plate 11, the lower chamber is a blower chamber 17, and the carrier gas is supplied to the blower chamber 17 from a gas supply section 180. The gas supply section 180 has a gas cylinder G, and a gas supply tube 18 which connects the gas cylinder G and the blower chamber 17. As the carrier gas, it is possible to use, for example, inert gas such as helium, argon or the like, or to use nitrogen, air, oxygen or the like.

The upper chamber is a powder-accommodating chamber 19, and particulate material (material particles) M is charged to the powder-accommodating chamber 19. The carrier gas supplied to the blower chamber 17 passes through the air dispersing nozzles 13 and then the carrier gas is ejected to the inside of the powder-accommodating chamber 19. With this, the particulate material M in the powder-accommodating chamber 19 is fluidized, thereby forming a fluidized bed M' above the distribution plate 11.

A window 19B is provided on a ceiling 19A of the powder-accommodating chamber 19, and an optical sensor 30 which is an optical measuring unit is arranged on the upper side of the window 19B. A transmissive plate, through which a measuring light having a predetermined wavelength is transmissive, is fitted to the window 19B so that a light emitted from the optical sensor 30 and a reflected light from the fluidized bed M' are transmissive through the transmissive plate. With this, it is possible to measure the position of a top layer M's of the fluidized bed M' by operating the optical sensor 30 outside the powder-accommodating chamber 19 in a state that the powder-accommodating chamber 19 is tightly sealed.

An aerosol delivery tube 21 is connected to the powder-accommodating chamber 19. The aerosol delivery tube 21 delivers (feeds) the aerosol generated in the powder-accommodating chamber 19 to an ejection nozzle 23 which will be described later on. One end of the aerosol delivery tube 21 is inserted to the powder-accommodating chamber 19 in a state that the aerosol delivery tube 21 extends in an up and down direction (extends vertically).

An adjusting unit (vertical position adjusting mechanism) 31 is attached to the aerosol delivery tube 21. The adjusting unit 31 adjusts a vertical position of a portion, of the aerosol delivery tube 21, inserted in the powder-accommodating chamber 19 (hereinafter referred to as "inserted portion 21A"). The adjusting unit 31 includes a driving section which drives the aerosol delivery tube 21 in up and down direction; and a CPU (Central Processing Unit) which is connected to the optical sensor 30 to receive a signal from the optical sensor 30 and give a drive command to the driving section. The adjusting unit 31 receives an information about the position, of the top layer M's of the fluidized bed M', measured by the optical sensor 30 and adjusts the vertical position of a suction port 21B formed at the tip end of the aerosol delivery 21, so that the suction port 21B is arranged at a position near to the top layer M's of the fluidized bed M'. Note that in the present application, the term "position near to" means a position at which the suction port 21B has no contact with the top layer M's of the fluidized bed M' and the suction port 21B is positioned above the top layer M' with a spacing distance, and at which the suction portion 21B is capable of sucking the particulate material M dispersed in the carrier gas.

The aerosol generator 10 is installed on a rotation device (horizontal driving mechanism) 40. The rotation device 40 includes a motor (not shown in the drawing) arranged on a base 41 and a rotary table 42 arranged on the upper surface of the base 41 and attached to a driving shaft of the motor. The aerosol generator 10 is placed on the rotary table 42.

Next, the film forming chamber 20 will be explained. The film forming chamber 20 is formed in a rectangular-box shape, and a stage 22 for attaching a substrate 26 thereto and an ejection nozzle 23 arranged below the stage 22 are provided inside the film forming chamber 20. The ejection nozzle 23 has a circular-cylindrical shape, has openings at both ends thereof in the up and down direction respectively, and the upper opening has a slit-shaped ejection port 23A formed therein. The lower opening of the ejection nozzle 23 is connected to the other end of the aerosol delivery tube 21 (the end opposite to the one end inserted into the powder-accommodating chamber 19), and the particulate material M and the carrier gas (aerosol) are supplied to the ejection nozzle 23 through the aerosol delivery tube 21.

The stage 22 has a rectangular-plate shape, and is capable of holding the substrate 26 on the lower surface of the stage 22. The stage 22 is suspended by a stage moving mechanism 24 in a horizontal posture from the ceiling of the film forming chamber 20. The stage moving mechanism 24 is driven in accordance with a command from a controller (not shown in the drawing), and moves the stage 22 in a plane parallel to the stage 22. This makes it possible to move the ejection nozzle 23 relative to the substrate 26. Further, a vacuum pump P is connected to the film forming chamber 20 via a powder recovery unit 25, and the inside of the film forming chamber 20 can be decompressed by the vacuum pump P.

Figure 3:
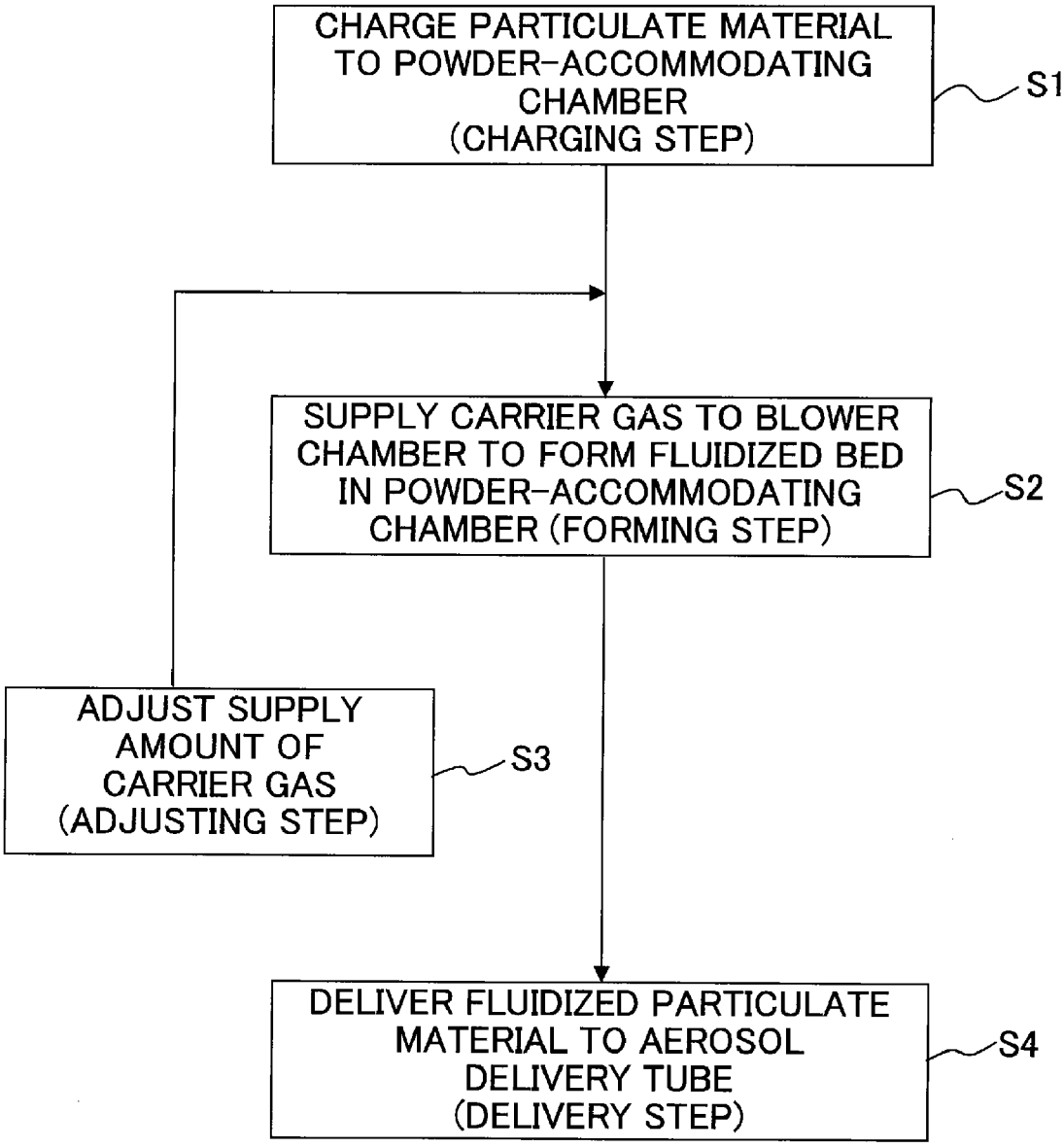
FIG. 3 is a flow chart showing a film-forming method as an embodiment of the present invention.

Next, an explanation will be given about a method for forming a film with the film-forming apparatus 1 constructed as described above, with reference to FIG. 3.

Upon forming a film of the particulate material M by using the film forming apparatus 1, first, the substrate 26 is set to the stage 22, and charge the particulate material M to the inside of the powder-accommodating chamber 19 (Charging step S1).

As the particulate material M, it is possible to use, for example, lead zirconate titanate (PZT) which is a piezoelectric material.

Next, the carrier gas is supplied from the gas cylinder G to the blower chamber 17 via the gas supply tube 18 (see arrows indicated in FIG. 2), and the carrier gas is ejected from the gas dispersion nozzles 13 to the powder-accommodating chamber 19 (Forming step S2). This fluidizes the particulate material M in the powder-accommodating chamber 19, thereby forming a fluidized bed M' above the distribution plate 11. In the fluidized bed M', the particulate material M is dispersed in the carrier gas, and aerosol is formed.

Here, in some case, disturbance is caused in the top surface M's of the fluidized bed M' due to gas bubbles generated between the particles of the particulate material M and rising upwardly in the aerosol. The inventor found out the following fact, in order to suppress the disturbance in the fluidized bed M', that it is effective to adjust the flow rate (flow velocity) of the carrier gas so that the fluidization velocity of the fluidized bed is not more than twice, preferably 1 to 2 times, of a minimum fluidization velocity $U_{MF}$ with respect to a central particle size of (particles of) the particulate material M. In this case, when the fluidized bed M' is formed, the fluidization velocity of the fluidized bed M' is equal to the flow rate of the carrier gas. Further, when the fluidized bed M' is formed, the particulate material M forms a cluster in which a plurality of particles of the particulate material M are aggregated, and the term "central particle size of the particulate material M" means a mean particle size in the cluster of the particulate material M. Further, the term "minimum fluidization velocity $U_{MF}$" means a fluidization velocity when the particles start to be fluidized (fluidization start velocity). In a case such as the embodiment of the present invention wherein a gas is flowed from a position below a solid particle layer to float the particles to thereby fluidize the particles, the minimum fluidization velocity $U_{MF}$ is equal to a minimum value of the gas flow velocity required for fluidizing the particles. The minimum fluidization velocity $U_{MF}$ is a value depending on a particle size (diameter) of the particles to be fluidized, a gas density and the like, and the minimum fluidization velocity $U_{MF}$ can be calculated, for example, by the following expression (1).

$$U_{MF} = \frac{(D_P\phi)^2}{f}\frac{\varepsilon_{MF}^3}{(1-\varepsilon_{MF})}\frac{(\rho_P-\rho)g}{\mu} \qquad \text{EXPRESSION (1)}$$

In the expression, $D_p$ is particle size (μm); f is constant; ϕ is specific surface area ($m^2/g$); $\mu_{MF}$ is voidage; $\rho_p$ is particle density ($kg/m^3$); p is gas density ($kg/m^3$); μ is gas viscosity (Pa·s); and g is gravitational acceleration ($m/s^2$).

Table 1 shows the minimum fluidization velocity in cases each using fine particles of PZT as the particles (particulate material) and helium as the carrier gas. For example, when calculation is made under the condition that the voidage (porosity) $\epsilon_{MF}$ is set to 10% as the upper limit for preventing the air bubbles generating between the particles, and that the constant f is 150 and the particle size $D_p$ is 0.8 μm, then a fluidization velocity of about 0.3 mm/s is required. The flow rate of the carrier gas, supplied from the gas cylinder G, is adjusted so that the fluidization velocity of the fluidized bed is not more than twice the minimum fluidization velocity $U_{MF}$ as calculated above (adjusting step S3). In this case, the supply amount of the carrier gas may be adjusted by opening/closing a valve of the gas cylinder G, and a flow-rate controlling mechanism which controls the flow rate of the carrier gas, such as a valve, a mass flow controller or the like, may be provided on the gas supply tube 18.

TABLE 1

| Particle size $D_p$ μm | Voidage $\epsilon_{MF}$ | Partticle true density $\rho_P$ kg/m$^3$ | Gas density ρ kg/m$^3$ | Gas viscosity μ $\times 10^{-6}$ Pa · Sec | Constant f | Specific surface area ϕ m$^2$/g | Ideal spherical area ratio ϕ in | fluidization velocity $U_{MF}$ mm/sec |
|---|---|---|---|---|---|---|---|---|
| 0.1 | 0.05 | 8000 | 0.5 | 9.1 | 150 | 10 | 1.78 | 0.00 |
| 0.5 | 0.05 | 8000 | 0.5 | 9.1 | 150 | 2.2 | 1.96 | 0.01 |
| 0.8 | 0.05 | 8000 | 0.5 | 9.1 | 150 | 1.8 | 2.56 | 0.03 |
| 1 | 0.05 | 8000 | 0.5 | 9.1 | 150 | 1.5 | 2.67 | 0.05 |
| 0.1 | 0.1 | 8000 | 0.5 | 9.1 | 150 | 10 | 1.78 | 0.00 |
| 0.5 | 0.1 | 8000 | 0.5 | 9.1 | 150 | 2.2 | 1.96 | 0.06 |
| 0.8 | 0.1 | 8000 | 0.5 | 9.1 | 150 | 1.8 | 2.56 | 0.27 |
| 1 | 0.1 | 8000 | 0.5 | 9.1 | 150 | 1.5 | 2.67 | 0.45 |

Next, the film forming chamber 20 is decompressed by the vacuum pump P while rotating the aerosol generator 10 by the rotation device 40. Then, pressure difference is generated between the powder-accommodating chamber 19 and the film forming chamber 20, which makes the particulate material M and carrier gas in the aerosolized state in the powder-accommodating chamber 19 to be sucked into the inside of the aerosol delivery tube 21, and accelerated at high velocity and delivered to the ejection nozzle 23 (delivering step S4).

At this time, by the rotation of the aerosol generator 10, the suction port 21B of the aerosol delivery tube 21 moves horizontally relative to the top layer M's of the fluidized bed M', along the top layer M's. By such a tracing operation, it is possible to avoid harmful effect which would be otherwise caused that the aerosol concentration is locally lowered if the suction is continued only at a specific position; it is possible to stabilize the concentration of the particulate material M sucked to the aerosol delivery tube 21; and it is further possible to stabilize the concentration of the aerosol ejected from the ejection nozzle 23.

It is enough that the suction port 21B at the tip of the aerosol delivery tube 21 is arranged close to the top layer M's of the fluidized bed M' to the extent that the suction port 21B is capable of sucking the particulate material M from the top layer M's, and it is preferable that the suction port 21B is maintained at a position at which the suction port 21B makes no contact with the top layer M's and is distanced from the top layer M's with a slight clearance or spacing distance therebetween, for the purpose of preventing the aggregation of the particulate material M at the suction port 21B.

A mixture of the particulate material M and the carrier gas (aerosol) supplied or delivered to the ejection nozzle 23 is ejected from the ejection port 23A toward the substrate 26. The ejected particulate material M is collided against and fixed to the substrate, forming a piezoelectric film. At this time, the ejection of the aerosol is performed by moving the stage 22 with the stage moving mechanism 24 to thereby change, little by little, the position of the ejection nozzle 23 relative to the stage 22. Accordingly, the film is formed entirely on the surface of the substrate. The aerosol, after colliding against the substrate, is discharged to the side of the powder recovery unit 25 by the suction force of the vacuum pump P.

When the film forming apparatus 1 is operated for a long period of time, then the particulate material M in the powder-accommodating chamber 19 is consumed and the position of the top layer M's of the fluidized bed M' is lowered. To address this situation, in the film forming apparatus 1, the vertical position of the aerosol delivery tube 21 is adjusted by the adjusting unit 31. The CPU of the adjusting unit 31 receives a positional information, of the top layer M's of the fluidized bed M', detected by the optical sensor 30. When the CPU of the adjusting unit 31 judges, based on the received positional information, that the position of the top layer M's is lowered from the suction port 21B of the aerosol delivery tube 21 by not less than a predetermined distance, then the CPU gives a drive command to the driving section to make the driving section move the aerosol delivery tube 21 in the up and down direction, thereby moving the suction port 21B to a position near to the top layer M's of the fluidized bed M1. In such a manner, the aerosol concentration is prevented from fluctuating due to the change in the distance between the top layer M's of the fluidized bed M' and the aerosol delivery tube 21 (suction height at which suction port 21B sucks the aerosol).

Further, since the non-contact type optical sensor 30 is used to measure the height of the top layer M's from outside the powder-accommodating chamber 19, there is no fear that the particulate material M adheres to the optical sensor 30 during the operation of the film forming apparatus 1. Accordingly, it is possible to prevent the measurement accuracy from lowering. In addition, the maintenance work becomes easy.

As described above, according to the embodiment, by forming the fluidized bed M', it is possible to prevent the aggregation and solidification of the particulate material M, and thus the particulate material M having a large particle size does not settle or deposit, thereby making it possible to realize uniform particle size distribution in the height direction (bed-height direction, axial direction of the aerosol generator 10). In addition, since the adjusting unit 31 is provided to adjust the end portion, of the aerosol delivery tube 21, with respect to the top layer M's of the fluidized bed M', the aerosol concentration is prevented from fluctuating due to the change in the distance between the top layer M's of the fluidized bed and the aerosol delivery tube 21, thereby making it possible to supply the aerosol stably.

The aerosol generator 10 is provided with the optical sensor 30 which measures the position of the top layer M's of the fluidized bed M', and the adjusting unit 31 adjusts the up and down direction of the aerosol delivery tube 21 based on the data of the position of the top layer M's measured by the optical sensor 30. Accordingly, even when the film forming apparatus 1 is operated for a long period of time and then the particulate material M in the powder-accommodating chamber 19 is consumed and the position of the top layer M's of the fluidized bed M' is lowered, it is possible to automatically perform an operation for detecting the position of the top layer M's to adjust the up and down direction of the aerosol delivery tube 21, and thus the suction of particles can be performed appropriately.

Furthermore, by the tracing operation for moving one end of the aerosol delivery tube 21 horizontally across (along) the top layer M's of the fluidized bed M', it is possible to avoid harmful effect which would be otherwise caused that the particle size distribution becomes non-uniform if the suction is continued only at a specific position; and to stabilize the concentration of the supplied aerosol.

Since the optical sensor 30 is a sensor of non-contact type and is arranged outside the powder accommodating chamber 19, there is no need to open the powder-accommodating chamber 19 for the measurement. Accordingly, there is no fear that the fluidized bed M' in the powder-accommodating chamber 19 from becoming unstable due to the influence of the measuring operation. Further, since the particulate material M does not adhere to the optical sensor 30 to pollute the optical sensor 30, the measurement accuracy is prevented from lowering and the maintenance becomes easy.

In addition, since the fluidization velocity of the fluidized bed M' is set to be not more than twice the minimum fluidization velocity with respect to the central particle size of the particulate material M, it is possible to suppress the disturbance in the fluidized-bed surface due to gas bubbles generated between the particles and rising upwardly.

The technical scope of the present invention is not limited to the embodiment as described above, and includes, for example, the following construction as well as encompassing equivalent thereof.

In the above-described embodiment, the distribution plate 11 as the partition is a multi-nozzle plate provided with a large number of the gas dispersing nozzles 13. However, it is enough that the partition is provided with a hole (hole portion) which allows the carrier gas to pass therethrough and the partition may be, for example, a porous sintered body, a punching metal or the like.

As the driving section of the adjusting unit, any driving mechanism may be used. For example, the driving mechanism may be a driving mechanism in which a ball screw and a motor (stepping motor, servo motor, or the like) are combined, and may be a driving mechanism which uses an air cylinder or an actuator. Similarly, the rotation device is not limited to a rotation device using a rotary table attached to the rotating shaft of the motor, and may use, for example, as the rotation device, any rotating mechanism in which a driving force of the motor is transmitted to a rotary table via a predetermined gear or the like.

In the above-described embodiment, the aerosol generator 10 is rotated by the rotation device 40 to thereby move the suction port 21A of the aerosol delivery tube 21 relative to the fluidized bed M' in the powder-accommodating chamber 19. It is allowable, however, to attach a horizontal driving unit to the aerosol delivery tube so as to directly move the aerosol delivery tube horizontally. As such a horizontal driving unit, it is allowable to use any horizontal driving mechanism such as a horizontal driving mechanism in which the above-described ball screw and motor are combined, a horizontal driving mechanism which employs an air cylinder or an (electric) actuator.

In the embodiment, although the optical sensor is used as a positional sensor of the non-contact type, the applicable non-contact type sensor is not limited to the optical sensor. It is allowable to use, for example, any positional sensor of non-contact type such as a supersonic sensor, magnetic sensor, or the like.

In the embodiment, although the suction port of the aerosol delivery tube is formed at a terminal end of the aerosol delivery tube, the position at which the suction port is formed is not limited to the terminal end. For example, the suction port may be formed in the aerosol delivery tube at an intermediate position on a side surface of the delivery tube.

What is claimed is:

1. An aerosol generating apparatus which generates aerosol in which a particulate material is dispersed in a carrier gas, comprising:

a container having a partition which partitions the container into a powder-accommodating chamber configured to accommodate the particulate material and a blower chamber disposed below the powder-accommodating chamber, a hole for passing the carrier gas being formed on the partition, and a fluidized bed of the particulate material being formed in the powder-accommodating chamber by the carrier gas supplied from the blower chamber;

a gas supply section which supplies the carrier gas to the blower chamber;

an aerosol delivery tube which has a suction port, and an end of which is inserted to the powder-accommodating chamber; and a vertical position adjusting mechanism which adjusts a vertical position of the suction port of the aerosol delivery tube relative to a position the fluidized bed, such that the suction port is positioned above a top surface of the fluidized bed with a spacing distance and the suction port faces toward the top surface of the fluidized bed.

2. The aerosol generating apparatus according to claim 1, further comprising a horizontal driving mechanism which moves the suction port horizontally relative to the powder-accommodating chamber.

3. The aerosol generating apparatus according to claim 1, further comprising a measuring unit which measures the position of the fluidized bed;

wherein the vertical position adjusting mechanism adjusts the vertical position of the suction port based on a data about the position of the fluidized bed measured by the measuring unit.

4. The aerosol generating apparatus according to claim 3, wherein the measuring unit includes a non-contact type sensor; and the non-contact type sensor is arranged outside the container.

5. The aerosol generating apparatus according to claim 4, wherein the non-contact type sensor is an optical sensor.

6. The aerosol generating apparatus according to claim 2, wherein the horizontal driving mechanism is a rotation device which rotates the container while holding the container thereon.

7. The aerosol generating apparatus according to claim 1, wherein the partition includes a plate having a projection which projects upwardly; and the hole has an opening in a lower surface of the plate, and is formed to include an air hole which is formed inside the projection to extend upwardly and a blow hole which communicates with the air hole and which is formed penetrating through a side surface of the projection in an obliquely downward direction.

8. A film forming apparatus which forms a film of a particulate material on a substrate by blowing onto the substrate an aerosol in which the particulate material is dispersed in a carrier gas, the apparatus comprising:

an aerosol generator generating the aerosol and including a container having a partition which partitions the container into a powder-accommodating chamber configured to accommodate the particulate material and a blower chamber disposed below the powder-accommodating chamber, a hole for passing the carrier gas being formed on the partition, and a fluidized bed of the particulate material being formed in the powder-accommodating chamber by the carrier gas supplied from the blower chamber;

a gas supply section which supplies the carrier gas to the gas-introducing chamber;

an aerosol delivery tube which has a suction port, an end of which is inserted to the powder-accommodating chamber; and a vertical position adjusting mechanism which adjusts a vertical position of the suction port of the aerosol delivery tube relative to a position of the fluidized bed, such that the suction port are positioned above a top surface of the fluidized bed with a spacing distance and the suction port faces toward the top surface of the fluidized bed; and an ejection nozzle which is connected to the other end of the aerosol delivery tube and which ejects the aerosol toward the substrate.

9. The film forming apparatus according to claim 8, further comprising a horizontal driving mechanism which moves the suction port horizontally relative to the powder-accommodating chamber.

10. The film forming apparatus according to claim 8, wherein the aerosol generator includes a measuring unit which measures the position of the fluidized bed; and the vertical position adjusting mechanism adjusts the vertical position of the suction port based on a data about the position of the fluidized bed measured by the measuring unit.

11. The film forming apparatus according to claim 10, wherein the measuring unit includes a non-contact type sensor; and the non-contact type sensor is arranged outside the container.

12. The film forming apparatus according to claim 11, wherein the non-contact type sensor is an optical sensor.

13. The film forming apparatus according to claim 9, wherein the horizontal driving mechanism is a rotation device which rotates the container while holding the container thereon.

14. The film forming apparatus according to claim 8, wherein the partition includes a plate having a projection which projects upwardly; and the hole has an opening in a lower surface of the plate, and is formed to include an air hole which is formed inside the projection to extend upwardly and a blow hole which communicates with the air hole and which is formed penetrating through a side surface of the projection in an obliquely downward direction.

15. The aerosol generating apparatus according to claim 1, wherein the vertical position adjusting mechanism is configured to adjust the vertical position of the suction port of the aerosol delivery tube relative to a position the fluidized bed, such that the aerosol delivery tube is positioned above the top surface of the fluidized bed with a spacing distance.

16. The film forming apparatus according to claim 8, wherein the vertical position adjusting mechanism is configured to adjust the vertical position of the suction port of the aerosol delivery tube relative to a position the fluidized bed, such that the aerosol delivery tube is positioned above the top surface of the fluidized bed with a spacing distance.

* * * * *